United States Patent [19]

Johansson et al.

[11] 4,168,135

[45] Sep. 18, 1979

[54] CASTING MACHINE WITH REINFORCEMENT INSERTING DEVICE

[75] Inventors: Henry S. Johansson, Stockholm; Elis R. Karlsson, Älvsjö, both of Sweden

[73] Assignee: AB Strängbetong, Stockholm, Sweden

[21] Appl. No.: 851,949

[22] Filed: Nov. 16, 1977

[30] Foreign Application Priority Data

Nov. 26, 1976 [SE] Sweden ..... 7613294

[51] Int. Cl.[2] ..... B28B 23/18

[52] U.S. Cl. ..... 425/64; 404/100; 425/113; 425/432

[58] Field of Search ..... 425/63-65, 425/432, 456, 113; 404/100

[56] References Cited

U.S. PATENT DOCUMENTS

| | | | |
|---|---|---|---|
| 2,596,206 | 5/1952 | Carnes | 404/100 |
| 3,083,621 | 4/1963 | Woolley et al. | 404/100 |
| 3,529,330 | 9/1970 | Martens | 425/63 |
| 3,566,758 | 3/1971 | Perkins | 404/100 |
| 3,853,444 | 12/1974 | Jones | 404/100 |
| 3,989,230 | 11/1976 | Martens | 425/432 |
| 4,022,556 | 5/1977 | Goetjew | 425/64 |

*Primary Examiner*—John McQuade

*Attorney, Agent, or Firm*—Birch, Stewart, Kolasch & Birch

[57] ABSTRACT

The present invention is directed to a device for introducing transversal reinforcement members in concrete bodies. In the casting of a concrete body, the casting machine and the concrete body move relative to each other during the casting operation. The present invention includes a storage member for reinforcement members with a device which feeds one reinforcement member at a time from the storage member to the surface of the concrete body. Pusher members are provided for positively introducing the reinforcement members into the concrete. The pusher members are connected to a knife which seals the opening through which the reinforcements members are introduced against upflow of concrete. Further, the present invention includes fin members to maintain the positioning of the reinforcement members in the concrete body.

5 Claims, 6 Drawing Figures

49
50
52
51
3
4
46
53
54
48
45
47
44
43
41
42
40
39
38
26
11
36
22
14

CASTING MACHINE WITH REINFORCEMENT INSERTING DEVICE

BACKGROUND OF THE INVENTION

1. Field of the Invention

The invention refers to a device for introducing transversal reinforcement members in concrete bodies, especially in connection with the casting of long concrete bodies in a casting machine, said casting machine and said concrete bodies moving relative to each other during the casting operation.

2. Description of the Prior Art

Machines for casting long concrete members are known in the prior art where the concrete is cast on fixed beddings. The machine moves on the fixed beddings and continuously discharges concrete which is vibrated and formed during the movement of the machine. In one known machine the movement of the machine is accomplished due to the concrete being discharged on the bedding by means of augers. The pressure thereby built up in the concrete on the discharge side of the augers thrusts the machine forwards along with the proceding casting operation. Another known machine uses strands and winches for its driving along the casting bed. In connection with both these types of machines non-prestressed as well as prestressed longitudinal reinforcement may be used in the concrete bodies. Longitudinal prestressed reinforcement has to be arranged on the casting bed before the casting operation, whereas non-prestressed reinforcement can be arranged either before the casting or continuously during the casting. Transversal reinforcement, however, has up to now only been possible to arrange before the casting and only within the bottom area of the concrete member as augers or vibrators hinder the introduction of transversal reinforcement in the top part of the body.

SUMMARY AND OBJECT OF THE INVENTION

There is often a need for transversal reinforcement also in the top part of a concrete body. An object of the present invention is to provide a device for introducing transversal reinforcement members in concrete bodies during the casting thereof. This object is achieved by the device set forth in the present invention.

Other objects and further scope of applicability of the present invention will become apparent from the detailed description given hereinafter. However, it should be understood, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF DRAWINGS

The present invention will become more fully understood from the description given hereinbelow and the accompanying drawings which are given by way of illustration only, and thus are not limitative of the present invention, and wherein.

DETAILED DESCRIPTION OF THE INVENTION

Figure 1:
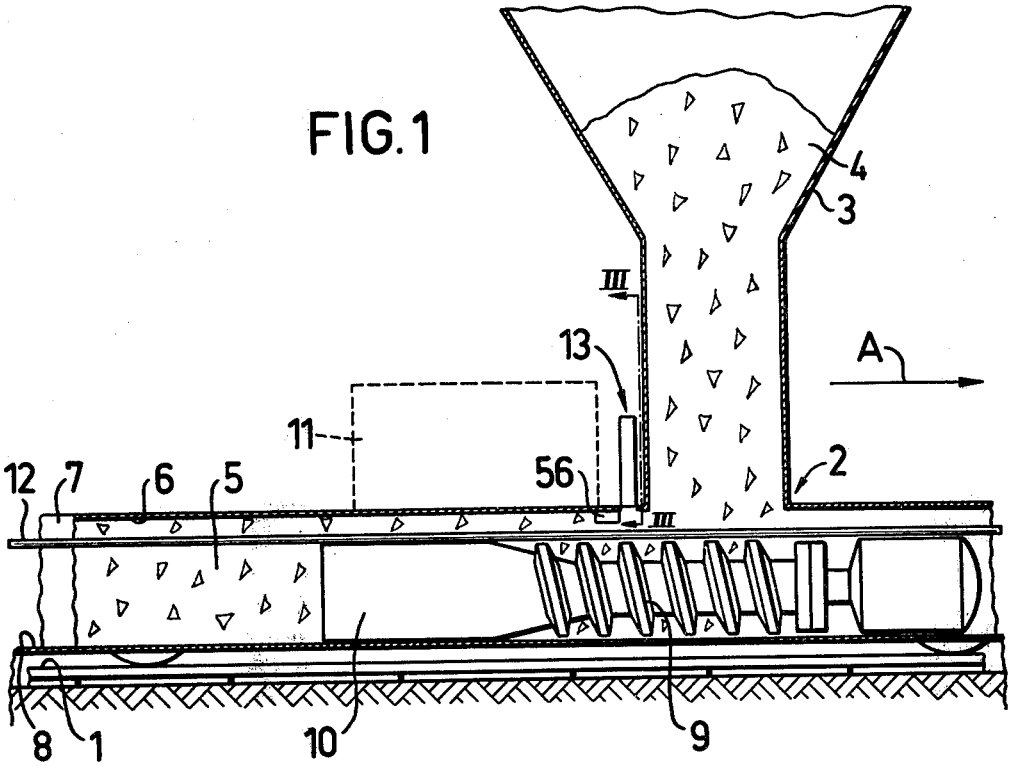
FIG. 1 is a longitudinal section through a schematically represented casting machine of a known type which has been supplemented with a device according to the present invention.

The schematically shown casting machine according to FIG. 1 is of a known type. It comprises a carriage 2 which is movable along a track 1 and it carries a hopper 3 for fresh concrete 4. The hopper 3 feeds the concrete downwards and opens to the interior of the downwardly open carriage which has an inner cross-sectional shape, often rectangular, corresponding to the cross section of the concrete body 5 to be cast. Thus, the inner walls 6, 7 of the carriage constitute the upper and side mold walls respectively, for the concrete body, whereas the lower mold wall or mold bottom is constituted by a stationary bedding 8 above which the carriage is moving. The casting machine shown as an example is of the type provided with motor driven augers 9 which at their ends carry follower tubes 10 forming longitudinal cylindrical channels (not shown) in the concrete body during the casting operation. When rotating the augers the concrete is pressed to the left according to FIG. 1 whereas the carriage as a result of the reaction force is forced rightwards in the direction of the arrow A. In this way a continuous concrete string of constant cross section and of desired length is cast on the mold bottom or bedding 8, while the mold walls 6,7 on the inside of the carriage slide along the concrete body. A vibrating plate and drive means therefor is schematically indicated with dotted lines and is designated 11. Other concrete vibration devices may also be provided, e.g. the follower tubes 10 may be provided with vibrators. A reinforcement which is previously located at a suitable distance from the bedding 8 is designated 12.

In another known type of casting machine (not shown) the feeding of the concrete is provided by the pressure caused by the weight of the concrete in the feeding hopper, the carriage being pulled by means of a strand or cable and a winch. Such a machine does not have the augers 9 and as a rule the feeding hopper for concrete is higher than the one shown.

Both said types of machines may, however, be provided with a device according to the present invention in order to introduce transversal reinforcement in the concrete body. Such a device which in the following description will be denominated reinforcement feeder, is indicated at 13 in FIG. 1 and will now be described more in detail.

The reinforcement feeder is suitably located near to the concrete hopper 3 and more specificially on the same side of the hopper as the direction of concrete discharge relative to the carriage.

Figure 3:
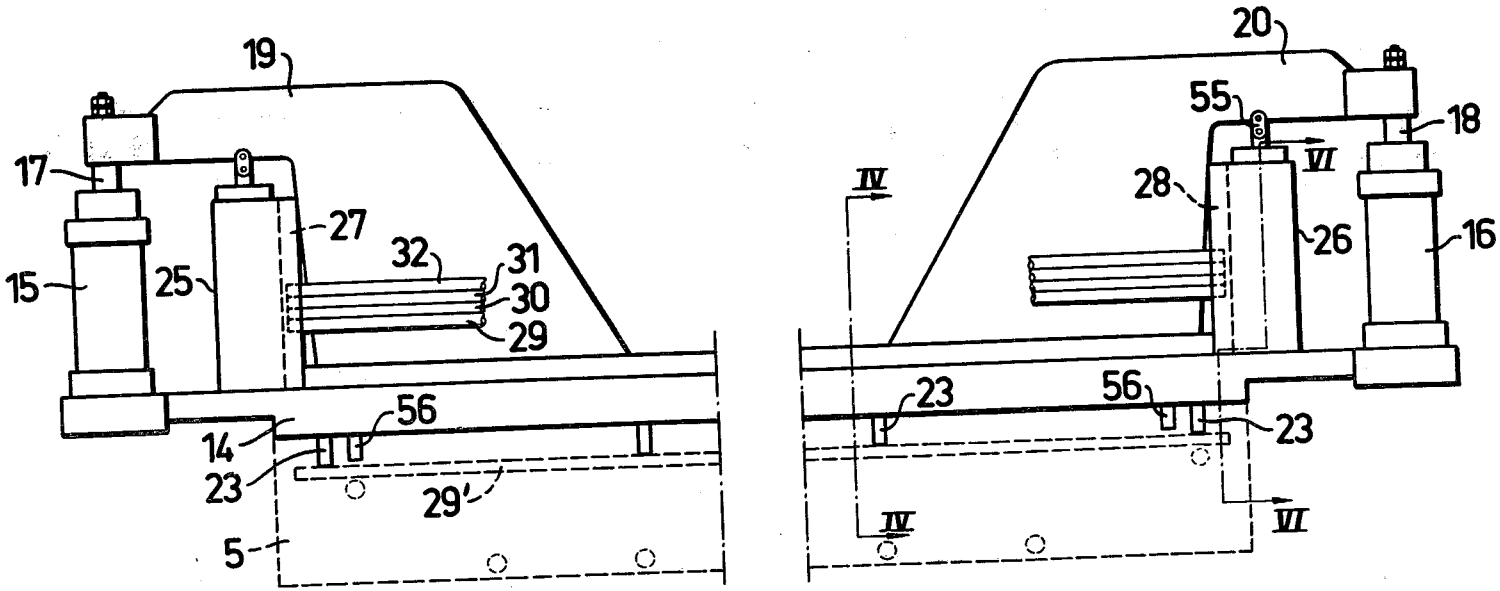
FIG. 3 illustrates the device according to the present invention as seen from the section III—III in FIG. 1.
Figure 4:
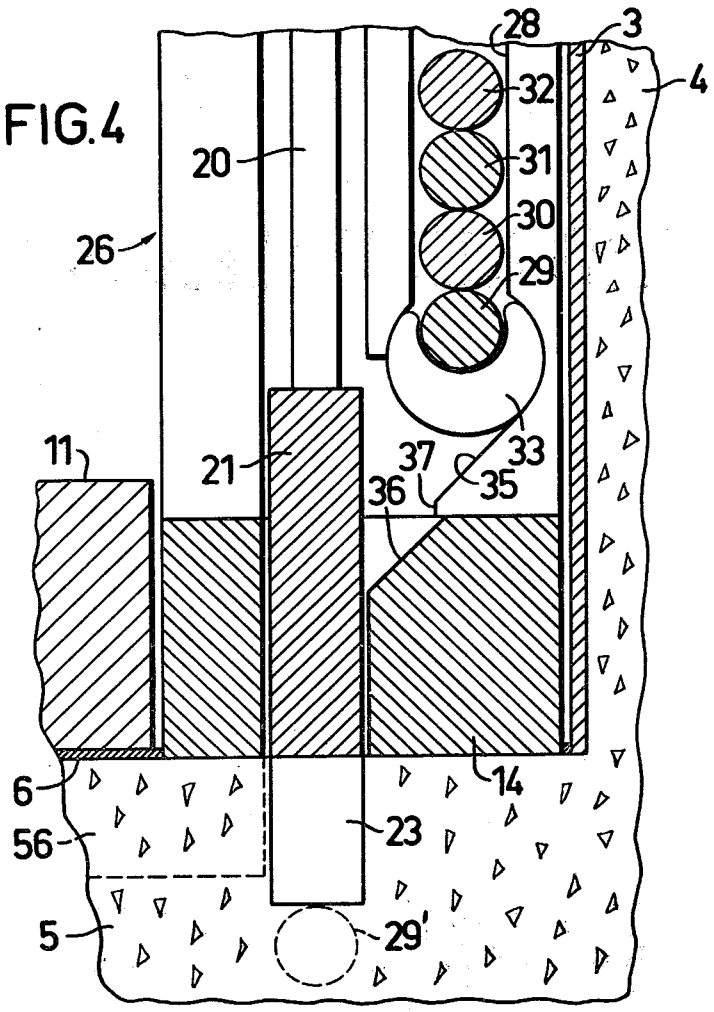
FIG. 4 is a section along line IV—IV in FIG. 3 showing, in an enlarged scale, a part of the reinforcement bar storage means and the feeding means.

The reinforcement feeder is shown in FIG. 3 as seen from the hopper 3 and towards the rear end of the carriage as seen in the direction of movement. In order to make the reinforcement feeder serviceable as an optional device to be selectively used with a casting machine, it is mounted on a frame member 14. The frame member 14 has a greater length than the width of the mold of the casting machine allowing it to be mounted on the casting machine transversally to the travelling direction thereof at a prearranged location, which according to the example shown in FIG. 1 is between the hopper 3 and the vibrating plate 11. At the extreme ends of the frame member 14 are fixed vertical hydraulic cylinders 15, 16 together with piston rods 17 and 18, respectively, of which each is fixed to the outer end of an arm 19 and 20, respectively. The arms 19 and 20 support a knife 21 spanning in the transversal direction of the machine, the knife 21 is movable between an upper position (FIG. 5) and a lower position (FIGS. 3 and 4). During the lower part of its path of movement the knife is guided in an opening 22 in the frame member 14. At its bottom edge the knife 21 carries a number of downwardly directed pushers 23 of equal length. When the knife is in its lower position, wherein its bottom edge is in alignment with the bottom of the frame member 14 which, in turn, is aligned with the mold wall 6 of the carriage 2, the pushers 23 extend into the mold chamber of the machine substantially down to the level where the transverse reinforcement shall be placed in the concrete body (a transverse reinforcement bar, the longitudinal reinforcement members and the outside contours of the concrete body are indicated in FIG. 3 with dotted lines). Inwardly of the respective hydraulic cylinders 15, 16 reinforcement bar storage and feeding units 25,26 are mounted to the frame 14. The storage part of each unit consists of a vertical slot 27 and 28, respectively, which opens towards the center of the machine and which houses the respective ends of several reinforcement bars 29, 30, 31 and 32, oriented in the transverse direction of the machine. The feeding part of each unit consists of feeding means and drive means therefor.

The two reinforcement bar storage and feeding units correspond to each other reversedly and, thus, only the right unit according to FIG. 3 will be described below.

Figure 5:
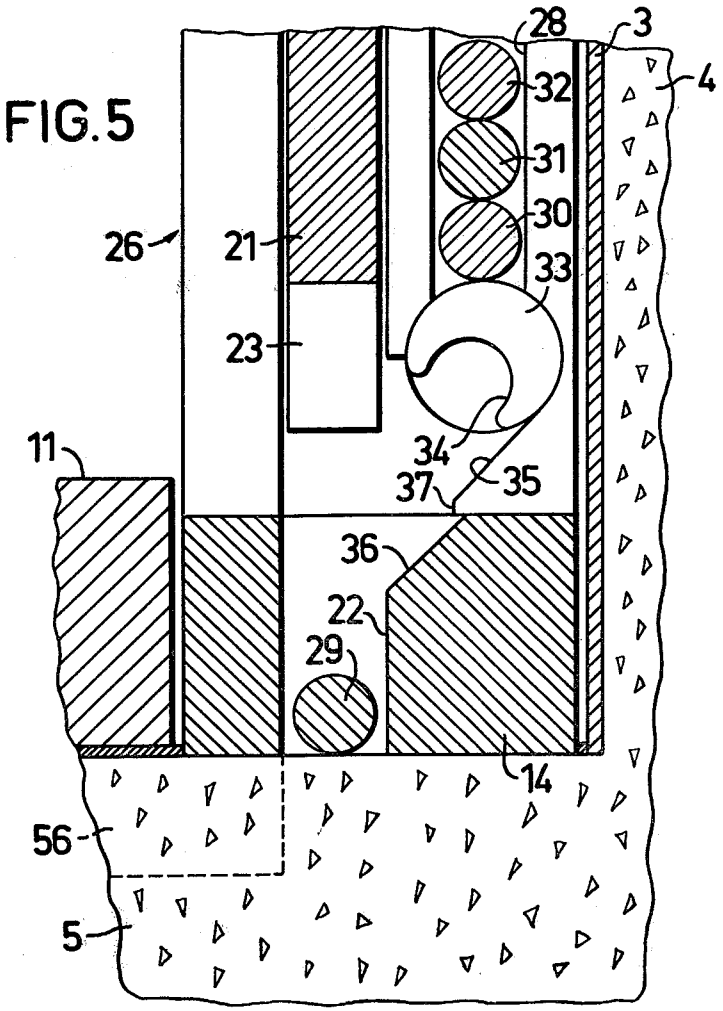
FIG. 5 is the same section as FIG. 4, but showing the feeding means in another position.

The feeding means is described with reference to FIGS. 4 and 5. The feeding means, which is located at the bottom of the respective slot 27, 28, consists of an exchangable body 33 rotatable between two positions. It is provided with an approximately U-shaped axial slot 34 which has a depth and a width corresponding to the diameter of the reinforcement bars in the storage means. By replacing body 33 with other similar ones having other dimensions of the slot 34, the feeding means can be adapted to different reinforcement bar sizes. In the first position of the feeding means the U-shaped slot 34 (FIG. 4) is turned upwards in order to allow a reinforcement bar 29 to fall down into the slot. In its second position the slot (FIG. 5) is turned downwards in order to allow the reinforcement bar to fall out of the slot. Below the feeding means 33 there is an inclined surface 35 that guides the reinforcement bar against the opening 22 in the frame 14. Also the opening 22 is provided with a sloping surface 36 that connects to the surface 35 preferably in such a way that a step 37 is provided between the two surfaces. This step eliminates the risk that a reinforcement bar is jammed at the junction between the two surfaces 35 and 36 on its way down towards the opening 22. In FIG. 5 the reinforcement bar 29 has completed its movement through most of the opening 22 and is shown resting on the surface of the concrete body 5 being cast.

Figure 6:
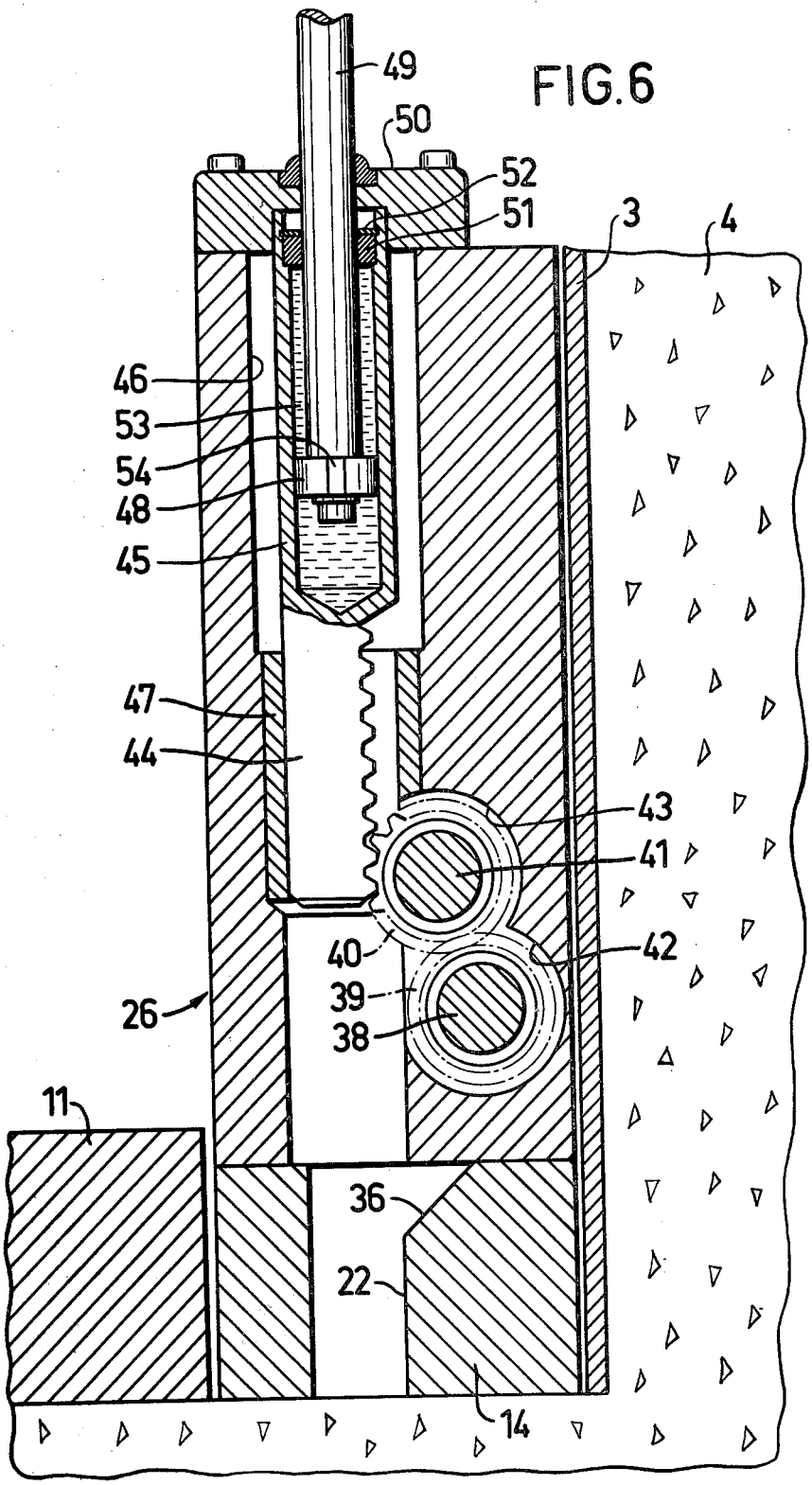
FIG. 6 is a sectional view along line VI—VI in FIG. 3 showing the details of the driving mechanism for the feeding means.

The drive means for the feeding means is described with special reference to FIG. 6. An axial extension of the rotatable body 33 formed as a shaft 38 serves as axis of rotation for a toothed gear wheel 39 fixed to said shaft. Gear wheel 39 meshes with another toothed gear wheel 40 the shaft 41 of which as well as shaft 38 is freely rotatively supported in the unit 26. The gear wheels 39 and 40 are housed in bores 42 and 43 respectively in the unit 26. The gear wheel 40 meshes with a vertical rack 44 which is a downward extension of a cylinder 45. The rack and cylinder unit is vertically movable in a bore 46 in the unit 26 and the lower part thereof is guided by a bushing 47. The cylinder 45 houses an axially movable piston 48 the piston rod 49 of which is axially displaceably supported in a lid 50 which is mounted on the top of the unit 26. At the top of the cylinder 45 the piston rod 49 is guided in a bushing 51 which is kept in place by a locking means 52. The upper part of the rack and cylinder unit is guided by the bearing of the piston rod in the lid 50. The cylinder is filled with oil 53. The piston 48 has recessed, plane surfaces 54 which allow a certain leakage of oil to pass between the piston and the bore thereby allowing the piston to be displaced through the cylinder being exposed to hydraulic resistance by the oil 53. The piston rod 49 is connected at the top to the arm 20 (FIG. 3) by a link 55.

The function of the reinforcement feeder will be described below, the right side of FIG. 3 being used as reference. In the resting position the knife 21 is positioned as shown in FIGS. 3 and 4. A number of reinforcement bars 29-32 are housed in the reinforcement bar storage means 28 resting on top of the feeding means 33 the slot 34 of which has received one reinforcement bar 29. The cylinder 45 with the rack 44 is in its bottom position as are also the piston rod 49 with the piston 48 in the cylinder 45 and the piston rod 18 in the cylinder 16.

When hydraulic pressurized oil is delivered to the lower side of the piston in the cylinder 16 the piston rod 18 is raised and thereby also the arm 20, the knife 21 and the piston rod 49. By a suitably adapted size of the recessed surfaces 54 on the piston 48 the hydraulic resistance of the oil 53 against movement of the piston 48 through the cylinder 45 will be so high that only a slight movement of the piston takes place. Instead, the main part of the upwards movement of the piston rod 49 will be transferred to the cylinder 45 and the rack 44 by the oil 53. The gear wheel 40 then rotates clockwise and the gear wheel 39 anti-clockwise according to FIG. 6. This causes an anti-clockwise rotation according to FIGS. 4 and 5 of the feeding body 33 causing its slot 34 to turn obliquely downwards against the opening 22. Because of the bypass of oil past the piston 48, the knife 21 and its pushers 23 have been lifted a greater or smaller distance. If the knife has been lifted enough to fully expose the opening 22 the reinforcement bar 29 will fall directly onto the concrete surface (FIG. 5), thereby possibly rolling against the surfaces 35 and 36. If the knife, however, only has been lifted a smaller distance the falling reinforcement bar will place itself between the knife or the pushers and the surfaces 35, 36 and will fall down on the concrete surface as soon as the pushers have been lifted high enough. The simultaneous upwards movement of the rack 44 and the cylinder 45 is limited by the lid 50 which serves as a stop for the cylinder thereby causing the remaining lifting movement of the piston rod 49 to take place by overcoming the hydraulic resistance from the oil 53 in the cylinder 45.

If now hydraulic pressurized oil is delivered to the upper side of the piston of the cylinder 16 the movements will reverse. Thus, the knife 21 with the pushers 23 will be moved downwards together with the piston rod 49. The gear wheels 40 and 39 then rotate anticlockwise and clockwise, respectively, and the body 33 rotates clockwise until it has regained the position shown in FIG. 4. Thereby a new reinforcement bar, now the bar 30, is received in the slot 34. During the later part of this movement, a combined movement takes place, as before, between the piston 48 and the cylinder 45 by overcoming the hydraulic resistance in the oil 53. During this later part of movement the pushers 23 of the knife 21 press the reinforcement bar 29 resting on the concrete surface down into the concrete 5 to a depth corresponding to the length of the pushers. A reinforcement bar 29' being pressed into the concrete is shown in FIG. 4 by dotted lines. In this position, which is the resting position of the knife, the bottom edge of the knife is at the same level as the top mold wall surface 6. The knife fills up, except for some clearance for avoiding jamming of aggregate particles of the concrete, the opening 22 whereby the concrete being under pressure in the molding chamber is hindered to leak out from the opening 22. The time for the knife to leave and return to its resting position for the feeding of a reinforcement bar is only a few seconds so only very small quantities of concrete can leak out from the opening 22.

Since the concrete is vibrated in the zone where the reinforcement bars are pushed down the concrete is relatively viscous and there is a risk that the reinforcement bars may "float" up to the concrete surface or in any case become unsatisfactorily displaced. It is therefore suitable to arrange fins 56 immediately behind the pushers 23 as seen in the relative direction of movement of the concrete. The fins project downwards into the molding chamber preferably to a somewhat lesser depth than the pushers 23 and are given a suitable length, e.g. such that the effect of the vibration has decreased sufficiently at the ends of the fins to make the concrete sufficiently solid to keep the reinforcement bars in the desired position.

Figure 2:
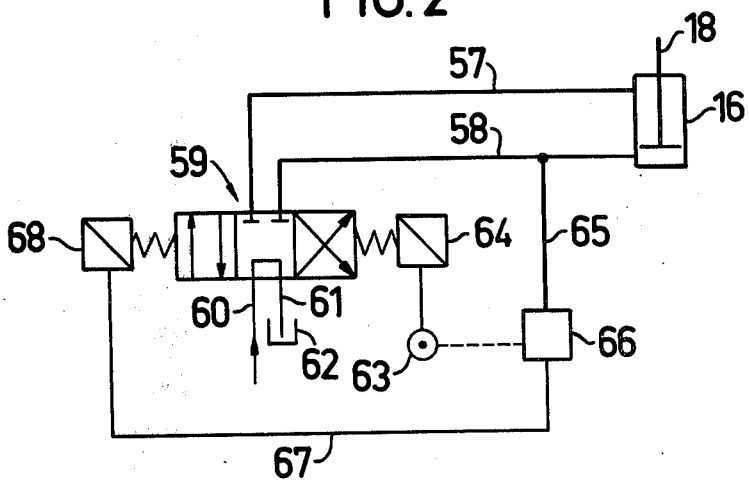
FIG. 2 is a scheme of a control circuit according to the present invention.

An electro hydraulic circuit for controlling the reinforcement feeder, i.e. operation of the hydraulic cylinders 15 and 16, is shown in FIG. 2. For the sake of simplicity, however, the cylinder 15 which is connected in parallel to the cylinder 16 has been excluded. At the upper and lower sides of the piston of the cylinder 16 oil conduits 57 and 58, respectively, are connected. These conduits are also each connected to one port of a solenoid valve 59. This valve has a neutral position wherein oil fed through a pressure conduit 60 is returned through a return conduit 61 to an oil receptacle 62. When a feeding sequence shall be performed an electrical impulse is given by a switch 63 to a solenoid 64 which switches the valve 59 to a first position wherein the pressure conduit 60 is connected to the conduit 58 leading to the cylinder 16 at the lower side of its piston and the return conduit 61 is connected to the conduit 57 at the upper side of the piston of the cylinder. Thereby the piston rod 18 is raised and the above described feeding of a reinforcement bar from the storage means 27, 28 takes place. From the conduit 58 is branched a conduit 65 which is connected to a timing relay 66. As the piston of the cylinder 16 reaches its top position the pressure increases in the conduit 58 and thereby also in the conduit 65 thereby activating the time relay 66, which, after a preset period of time, switches off the current to the solenoid 64 and sends an electrical impulse to a second solenoid 68 through an electrical conduit 67 switching the valve 59 to a second position, wherein the pressure conduit 60 is connected to the conduit 57 and the return conduit 61 is connected to the conduit 58 causing the piston rod 18 to move downwards thereby pressing a reinforcement bar into the concrete as described above. The delay of activation of the solenoid 68 by the time relay 66 gives a reinforcement bar sufficient time to fall from the feeding means to the concrete surface. Correspondingly, the time relay 66 can be adjusted to keep the valve 59 in its second position by means of the solenoid 68 during a sufficient period of time for a reinforcement bar to be depressed into the concrete. After lapse of this period of time the feeding of electrical current to the solenoid 68 ceases and the valve returns to its resting position.

The initial impule may be manually given by an operator or automatic. In the latter case impulses can be given, e.g. at regular time intervals, after preset travel distances of the carriage 2 or by inductive sensing of previously introduced reinforcement bars.

The reinforcement feeder described above can of course be modified in several ways. For example, the knife 21 can have its resting postion in the upper position in which case other retractable means must be arranged to obtain sealing of opening 22. It is also possible to let the knife have its resting position described, whereas the pushers 23 are axially movable within the knife such that they are retracted into the knife after a completed pushing down of a reinforcement bar.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claim.

We claim:

1. In a movable casting machine for continuously casting elongate concrete bodies a device for introducing transversal reinforcement members in a concrete body, the body comprising:

a frame member which includes a storage means for containing reinforcement members;

feeding means for feeding one reinforcement member at a time from the storage means through an opening in said frame member to a position close to a top surface of the concrete body;

a substantially vertically movable knife means for positive introduction of the reinforcement member into the concrete body, said knife means being mounted for movement within said opening in said frame member;

said knife means being movable to a first position within said opening to permit the feeding of a reinforcement member to the top surface of the concrete body; and said knife means being movable to a sealing position to seal the opening against upflow of concrete and positively introduce the reinforcement member into the concrete body.

2. A combination according to claim 1, characterized in that the knife means extends over an essential part of a width dimension of the concrete body and its movement being synchronized with the feeding means for the reinforcement members such that a reinforcement member is fed from the storage means when the knife means is in said first position and the reinforcement member is given time to place itself on the top surface of the concrete body before the knife means is moved to the sealing position.

3. A combination according to claim 2, characterized in that the knife means is provided with several downwardly projecting pushers, the length of said pushers defining the level of depth of the reinforcement members in the concrete body.

4. A combination according to claim 3, and further including fin means for maintaining the level of depth of said reinforcement members in said concrete body, said fin means being arranged after the knife as means on the casting machine, said fin means projecting to a lesser extent into the concrete body than the pushers of the knife means in the sealing position thereof.

5. In a movable casting machine for continuously casting elongate concrete bodies a device for introducing transversal reinforcement members in a concrete body, the body comprising:

a frame member which includes a storage means for containing reinforcement members;

feeding means for feeding one reinforcement member at a time from the storage means through an opening in said frame member to a position close to a top surface of the concrete body;

a substantially vertically movable knife means for positive introduction of the reinforcement member into the concrete body, said knife means mounted for movement within said opening in said frame member;

said knife means being movable to a first position within said opening to permit the feeding of a reinforcement member to the top surface of the concrete body; and said knife means being movable to a sealing position to seal the opening against upflow of concrete and positively introduce the reinforcement member into the concrete body; and fin means for maintaining the level of depth of said reinforcement members in said concrete body, said fin means being positioned downstream of said knife means and projecting to a lesser extent into the concrete body than the pushers of the knife means in the sealing position thereof.

* * * * *